US005707330A

United States Patent [19]

Kiamco et al.

[11] Patent Number: 5,707,330

[45] Date of Patent: Jan. 13, 1998

[54] FOLDING MACHINE FOR FOLDING AND CUTTING WEBS IN A ROTARY PRINTING PRESS

[75] Inventors: Robert C. Kiamco, Wood Dale; Robert E. Hansen, Clarendon Hills; Frank A. Balow, Western Springs, all of Ill.

[73] Assignee: Goss Graphic Systems, Inc., Westmont, Ill.

[21] Appl. No.: 623,557

[22] Filed: Mar. 28, 1996

Related U.S. Application Data

[63] Continuation-in-part of Ser. No. 353,430, Mar. 24, 1995, abandoned.

[51] Int. Cl.[6] ..... B65H 45/16; B65H 35/06

[52] U.S. Cl. ..... 493/357; 493/425; 493/471; 493/472

[58] Field of Search ..... 493/353, 357, 493/362, 369, 372, 426–430, 471, 472; 270/49, 50; 83/304, 305

[56] References Cited

U.S. PATENT DOCUMENTS

| | | | |
|---|---|---|---|
| 1,802,554 | 4/1931 | Hahn | 83/305 |
| 1,829,244 | 10/1931 | Smith | 493/353 |
| 3,784,187 | 1/1974 | Takayanagi | 493/362 |
| 4,917,665 | 4/1990 | Couturier | 493/472 |

*Primary Examiner*—Jack W. Lavinder

*Attorney, Agent, or Firm*—Marshall, O'Toole, Gerstein, Murray & Borun

[57] ABSTRACT

The present invention provides an apparatus for producing at least two 4-page signatures (340) and an apparatus for producing at least one 16-page signature (460). The signatures are produced by folding and cutting sheets cut from a continuous web in a folding machine (500 or 600). The apparatus of the present invention provides a selectable blade device which folds or folds and cuts sheets being processed in the device. When placed in the fold and cut position, the apparatus is capable of producing at least two 4-page signatures (340) or at least one 16-page signature (460) without the need for a final off-line trimming step.

8 Claims, 5 Drawing Sheets

FOLDING MACHINE FOR FOLDING AND CUTTING WEBS IN A ROTARY PRINTING PRESS

CROSS REFERENCE TO RELATED APPLICATIONS

This application is a continuation-in-part of U.S. Ser. No. 08/353,430 filed on Mar. 24, 1995, now abandoned.

FIELD OF THE INVENTION

The present invention relates generally to a folding machine for cutting sheets from a continuous web and folding those sheets, and more particularly, to a folding machine for cutting sheets from a continuous web and selectively folding or folding and cutting those sheets.

BACKGROUND OF THE INVENTION

In the rotary web-feed printing industry, pages of magazines, inserts, flyers and the like are first printed on a continuous web. The continuous web is then folded and cut into smaller pieces to form the final product. These smaller pieces are known in the art as signatures. A signature is a folded printed sheet that can contain 4 or more pages. A signature is prepared from the preprinted continuous web on a web-formed machine.

One of the ways that a 16-page signature is currently produced involves folding a web along a first fold-line to form a stacked web of two ribbons. The stacked web of two ribbons is then cut and folded along a second fold-line to produce a stack of four joined sheets. The second fold-line is perpendicular to the first fold-line. Next, the stack of four joined sheets is folded along a third fold-line to produce a stack of eight joined sheets. The third fold-line is either parallel or perpendicular to the second fold-line. The stack of eight joined sheets is then trimmed along a trim-line(s) to produce one 16-page signature. This final trimming step typically requires a separate trimming machine.

A major disadvantage of the above described process is that a signature is not produced until the final trimming is finished. Consequently, there is a need for an apparatus that can produce a signature without the final trimming thereby reducing the cost and time required to produce signatures.

In some cases, however, it will still be desirable to only fold the signatures. Therefore, it is desirable to provide an apparatus which is flexible enough to produce signatures which can be either folded or simultaneously folded and cut. The present invention provides such a device.

SUMMARY OF THE INVENTION

According to one embodiment, the present invention discloses a method for manufacturing at least two 4-page signatures without the need for a separate, final trimming step. The steps involved include folding a web in half along a first fold line using a forming apparatus and then cutting the folded web into a folded sheet and finally simultaneously folding and cutting the half-folded sheet along a second fold-line that is perpendicular to the first fold-line so as to produce two 4-page signatures.

In another embodiment, the two 4-page signatures as produced above can be further folded and cut along one or more additional fold-lines which are perpendicular to the first fold-line, to provide additional 4-page signatures. For each additional fold/cut line perpendicular to the first fold-line, additional 4-page signatures are provided.

According to another embodiment, the present invention discloses a method for forming at least one signature of 16-pages. The steps involved in this method include folding and cutting (or folding and slitting) a web along a first-fold line, using a slitter blade and former board to form a stacked web of two ribbons. The stacked web of two ribbons is then cut into two stacked sheets. Next the two stacked sheets are folded and cut along a second-fold line that can be either parallel or perpendicular to the first fold-line to produce a stack of four sheets. The stack of four sheets is next folded in half along a third fold-line which is either parallel or perpendicular to the first fold-line to produce one 16-page signature.

In accordance with another embodiment of the present invention, a folding machine for producing at least two 4-page signatures is provided. The apparatus includes a former board for producing the first fold in the web, and a pair of rotating folding and cutting cylinders for folding and cutting the web into at least two 4-page signatures.

In accordance with yet another embodiment of the present invention, a folding machine for producing at least one 16-page signature is provided. The apparatus includes a slitter blade and former board for cutting and folding the web in half along the longitudinal direction so as to produce two stacked ribbons. The apparatus further includes three rotating cylinders which cooperate with one another to fold and cut the two ribbons into at least one 16-page signature. Two of the rotating cylinders cooperate to cut the stacked ribbons into stacked sheets and then fold and cut the stacked sheets in half through a fold-line which is perpendicular to the first longitudinal fold. Four stacked sheets are thus formed during in this step. A different pair of rotating cylinders cooperate to fold the four stacked sheets in half through an additional fold-line which is perpendicular to the first longitudinal told, thereby forming a 16-page signature.

BRIEF DESCRIPTION OF THE DRAWINGS

Other aspects and advantages of the present invention will become apparent upon reading the following detailed description and upon reference to the drawings in which.

DETAILED DESCRIPTION OF THE INVENTION

The present invention discloses a folding machine for producing signatures in a web-fed rotary printing press. As used herein the terms "signature" and "book" are interchangeable and denominate identical products. A preferred folding machine is a C-500 or a C-700 manufactured by Rockwell International with modifications as described herein.

Figure 1A:
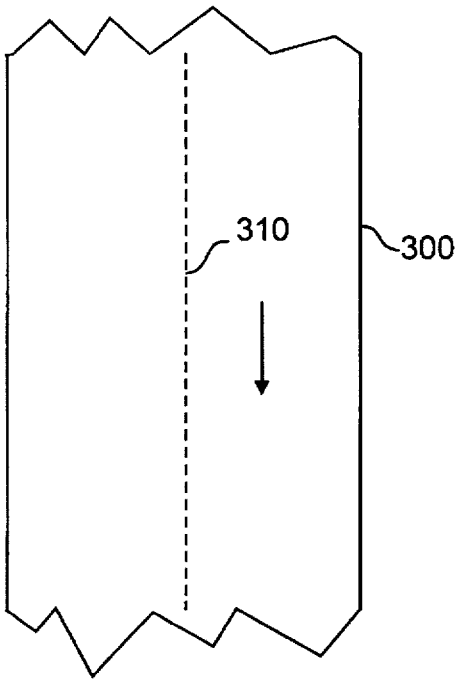
FIGS. 1A–1D illustrate a method of manufacturing two 4-page signatures.
Figure 1B:
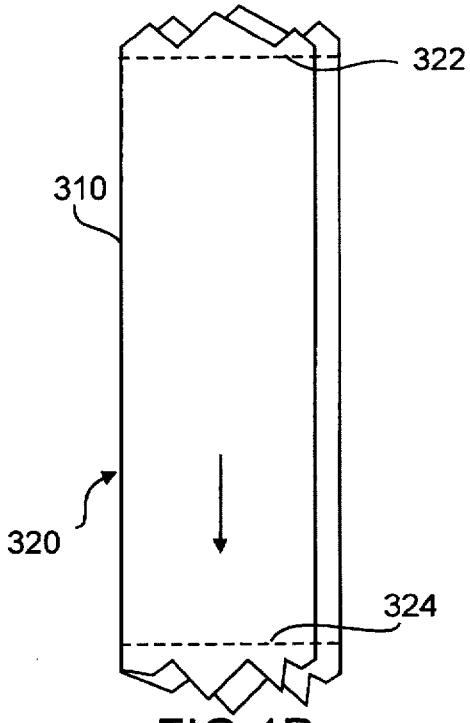
Figure 1C:
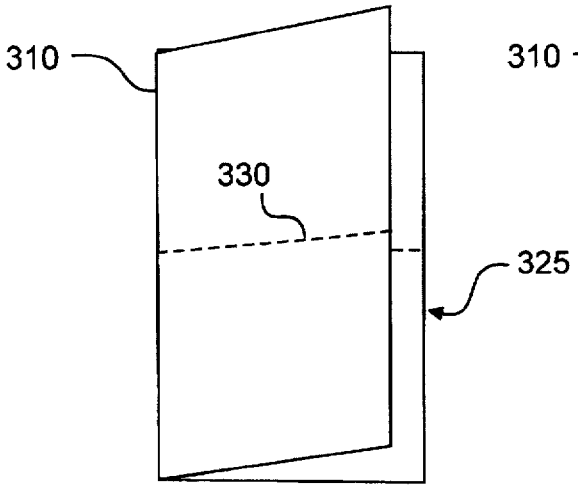
Figure 1D:
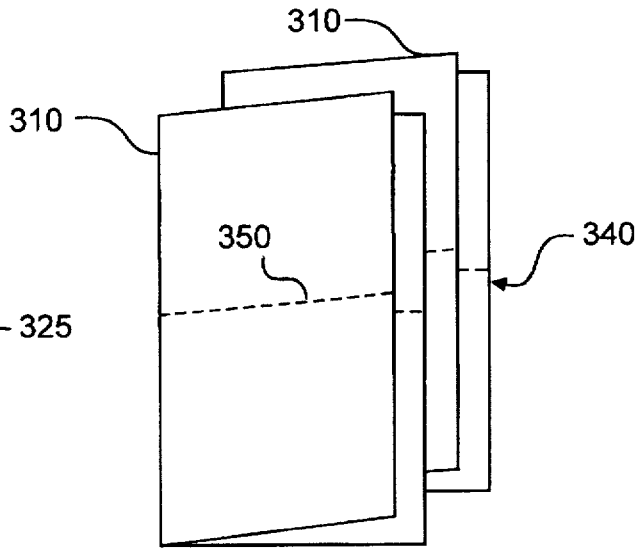

Referring now to FIGS. 1A–1D, the production of multiple 4-page signatures in accordance with the principles of the present invention is illustrated. In accordance with this embodiment of the present invention, web 300 is folded in half along a fold-line 310 resulting in a folded web 320, as shown in FIG. 1B. The folded web 320 is then cut along lines 322 and 324 to form folded sheet 325, as shown in FIG. 1C. Simultaneous with this step, the folded web 320/folded sheet 325 is folded and cut in half along the cut-line 330. The cut-line 330 is perpendicular to the fold-line 310 of FIG. IA. This method produces two stacked 4-page signatures 340, as shown in FIG. 1D. Additional 4-page signatures can be produced by folding and cutting the signatures 340 along cut-lines 350.

This method is advantageous in that multiple 4-page signatures can be produced in one folding and cutting apparatus without the need for an off-line trimming step.

Figure 2A:
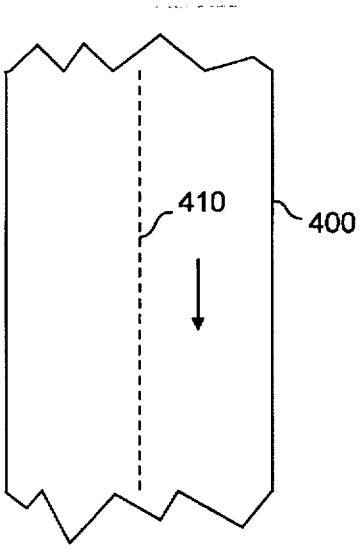
FIGS. 2A–2E illustrate a method of manufacturing a 16-page signature.
Figure 2B:
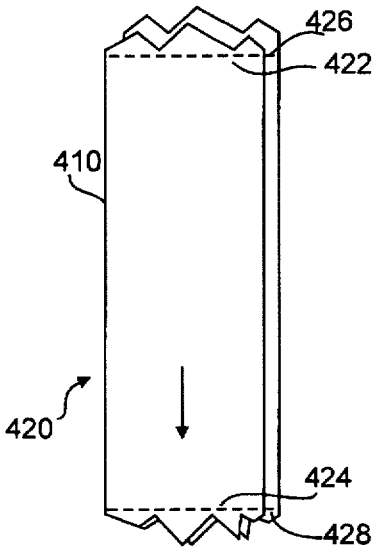
Figure 2C:
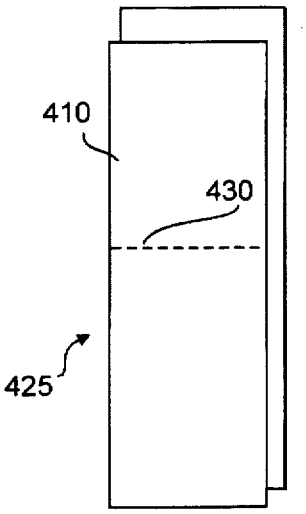
Figure 2D:
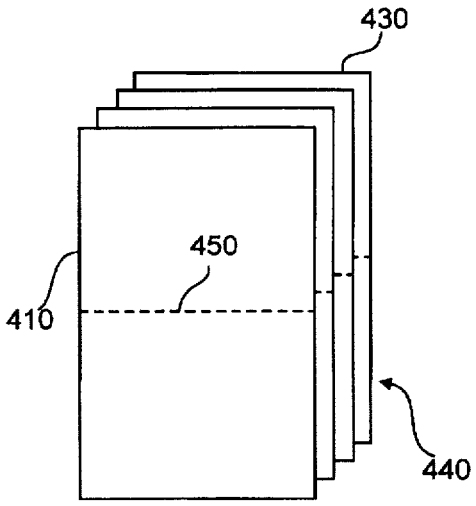
Figure 2E:
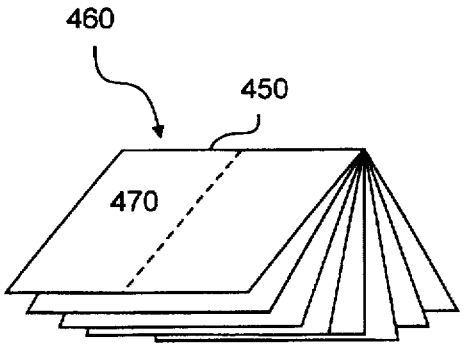

Referring now to FIGS. 2A–2E, a web 400 is folded and cut in half along the cut-line 410. This step of folding and cutting along the cut-line 410 produces a stacked web of two detached ribbons 420, as shown in FIG. 2B. The stacked web of two detached ribbons 420 is then cut along lines 422, 424, 426 and 428 to form a stack of two detached sheets 425, shown in FIG. 2C. The stack of two detached sheets 425 is then folded and cut in half along the cut-line 430. As shown, the cut-line 430 is perpendicular to cut-line 410 of FIG. 2A. However, because the stack of two detached sheets 425 can be of any size and orientation, cut-line 430 can be parallel to cut-line 410. Folding and cutting along cut-line 430 results in a stack of four detached sheets 440, as shown in FIG. 2D. The stack of four detached sheets 440 is folded in half along fold-line 450 to produce a 16-page signature 460, as shown in FIG. 2E. Because the size and orientation of the stack of four detached sheets 440 are variable, fold-line 450 can be either parallel or perpendicular to cut-line 410.

If more than two 16-page signatures are desired additional folding and cutting steps along a cut-line that is parallel to fold-line 470 can be performed.

The above described methods are advantageous in that at least one 16-page signature can be produced in one folding and cutting apparatus without the need for an off-line trimming step.

Figure 3:
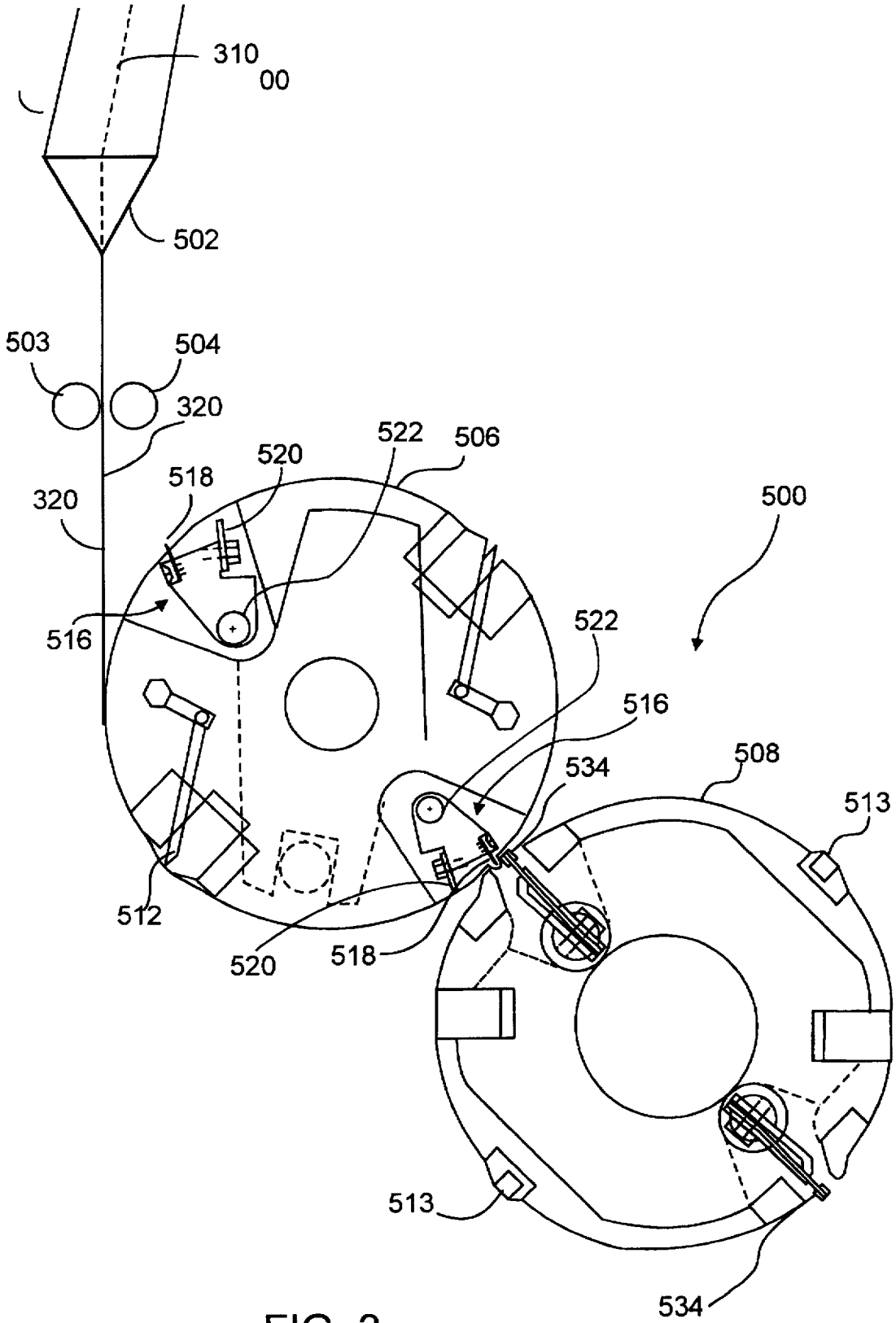
FIG. 3 is a schematic diagram of a folding machine for producing at least two 4-page signatures or one 8-page signature.

Referring now to FIG. 3, a folding machine 500 for producing the at least two 4-page signatures 340 shown in FIG. 1D is illustrated. The folding machine 500 includes a former board 502 which folds the web 300 in half to produce the half-folded web 320. The half-folded web 320 passes through a pair of nip rollers 503 and 504 which form a crease in the fold. The half-folded web 320 is then fed between two rotating cylinders 506 and 508. Cylinder 506 is a half-folder cutting cylinder and cylinder 508 is a half-folder jaw cylinder. When the folded web 320 is fed into the half-folder cutting cylinder 506 cutting cylinder pins 512 on the periphery of the half-folder cutting cylinder 506 cooperate with anvils 513 on the half-folder jaw cylinder 508 to cut the web 320 to produce the single 4-page signature 325 shown in FIG. 1C.

The signature 325 is also folded and cut in half by a selectable blade device 516 attached on the periphery of the half-folder cutting cylinder 506 and by movable jaw 534 on the half-folder jaw cylinder 508. As will be appreciated by those of ordinary skill in the art, the cutting of the web 320 into sheets 325 and the folding and cutting of sheets 325 will occur substantially simultaneously.

The selectable blade device 516 includes a knife blade 518 and a tucker blade 520 mounted on a shaft 522. The distance of the tip of the knife blade 518 to the center of the shaft 522 is longer than the distance of the tip of the tucker blade 518 to the center of the shaft. Furthermore, the tip of the knife blade 518 has a serrated edge to cut the signatures.

Figure 5A:
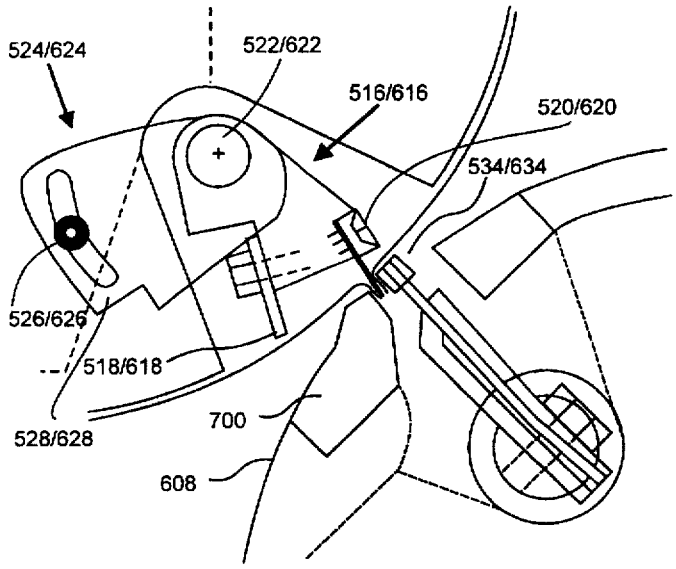
FIG. 5A is a schematic diagram of an enlarged section of two rotating cylinders in which one of the cylinders includes a selectable blade device shown in a folding and cutting position.
Figure 5B:
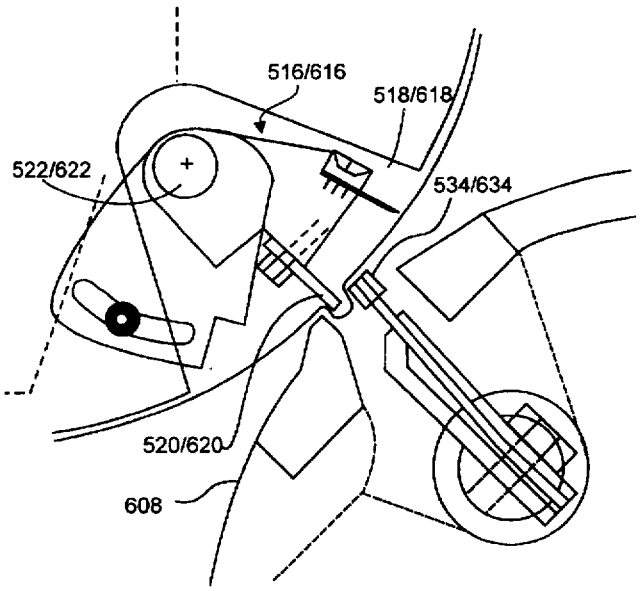
FIG. 5B is a schematic diagram of an enlarged section of the same two rotating cylinders illustrated in FIG. 5A showing the selectable blade device in a folding position.

The selectable blade device 516 can assume two different positions. In a first position, the knife blade 518 is engaged so that it can cooperate with the movable jaw 534 to simultaneously fold and cut the sheets 325. This configuration of the folding machine 500 produces two 4-page signatures. In a second position, the tucker blade 520 is engaged so that it can cooperate with the movable jaw 534 to fold the sheets 325, as shown in FIG. 5B. This configuration of the folding machine 500 produces one 8-page untrimmed signature. A lever 524/624 is used to switch the selectable blade device 516 (and 616) from the knife blade position to the tucker blade position as shown in FIGS. 5A and 5B. The lever 524/624 pivots about the shaft 522/622 and is locked into place by a cap screw 526/626, which slides along a groove 528/628 formed in the lever. This switching operation is performed once the folding machine is turned off and the cylinders 506/606 and 508/608 have stopped rotating.

The advantage of placing the selectable blade 516 in the knife blade position is that the signature 325 is cut while it is folded so that there is no need for a final trimming step. However, a further advantage of the design is that if it is desired only to fold the signature, then that can be accomplished simply by placing the selectable blade device 516 in the tucker blade position. The selectable blade device 516, therefore, makes the folding machine 500 versatile, so that it can either fold the signatures only or fold and cut them depending upon the needs of the printing process.

Figure 4:
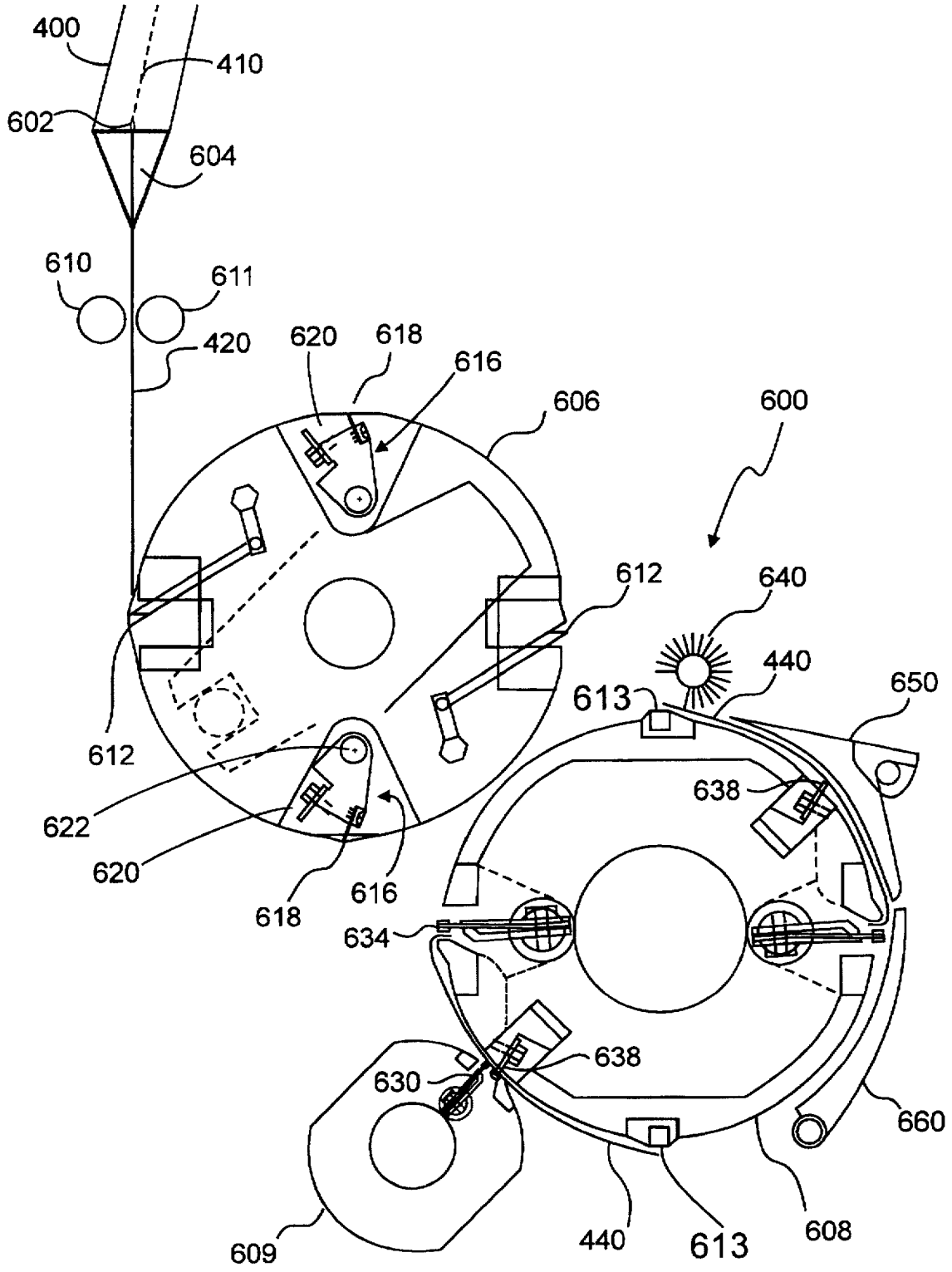
FIG. 4 is a schematic diagram of a folding machine for producing a trimmed or untrimmed 16-page signature.

Referring now to FIG. 4, a folding machine 600 for manufacturing the 16-page signature 460 shown in FIG. 2E is illustrated. The apparatus 600 includes a slitter blade 602 and former board 604 which slit the web 400 in half longitudinally and stack the slit web 400 over itself thereby forming the two stacked ribbons 420 shown in FIG. 2B. The two stacked ribbons 420 are then fed into a half-folder cutting cylinder 606, half-folder jaw cylinder 608 and double-parallel-folder jaw cylinder 609 by a pair of nip rollers 610 and 611.

Two parallel transverse cuts are made in the two stacked ribbons 420 at lines 422, 424, 426 and 428 to form the two stacked detached sheets 425 shown in FIG. 2C. The transverse cuts are made by a pair of cylinder pins 612 and associated pair of anvils 613.

The two stacked sheets 425 are in turn folded and cut in half by the selectable blade device 616 on the half-folder cutting cylinder 606 and by movable jaw 634 on the half-folder jaw cylinder 608. When the selectable blade device 616 is in the knife blade position it both folds and cuts the two stacked sheets 425 in one step, thereby forming the four stacked sheets 440 shown in FIG. 2D. The four stacked sheets 440 are then folded in half by the cooperating action of double-parallel-folder movable jaw 630 of the double-parallel-folder jaw cylinder 610 and the folding blade 638 of the half-folder jaw cylinder 608. The above described apparatus produces the 16-page signature 460 (shown in FIG. 2E) without the need for a final trimming step.

When the selectable blade 616 is in the tucker blade position (shown in FIG. 5B), it only folds the two stacked sheets 425, thereby forming an 8-page signature. If the signature is further folded by the movable jaw 630/folding blade 638 pair, a 16-page untrimmed signature is produced.

The folding machine 600 further includes a rotary brush 640 which operates to keep the tail section of the folded signatures 340 from flapping about and thus becoming misaligned. A half-folder stripper shoe/guide shoe 650 is also provided. In one position the device 650 functions as a half-folder stripper shoe stripping the signatures 440 off of the surface of the half-folder jaw cylinder 608 and directing them into a delivery fly (not shown). In this position, the folding machine 600 operates in the same way as the folding machine 500. In another position, the device 650 functions as a guide shoe which functions to keep the signatures on the surface of the cylinder 608. In this position the device 650 cooperates with a delivery guide shoe 660 to guide the signatures 440 between the cylinders 608 and 609.

Referring now to FIGS. 5A and 5B, enlarged views of the selectable blade device (516 or 616) and movable jaw (534 or 634) pair are shown. In the knife blade position, the selectable blade (516 or 616) cooperates with an anvil 700 and with the movable jaw (534 or 634) to fold and cut the sheets, as shown in FIG. 5A. In the tucker blade position, the selectable blade (516 or 616) cooperates with the anvil 700 and the movable jaw (534 or 634) to fold the sheets being processed in the folding machine 500/600, as shown in FIG. 5B. The lever 524/624 switches the selectable blade device (516 or 616) from the knife position to the tucker blade position as described above.

The above described embodiments are presented to describe preferred embodiments and utilities of the present invention. While the invention is susceptible to various modifications and alternative forms, specific embodiments thereof have been shown and were herein described in detail. It should be understood, however, that it is not intended to limit the invention to the particular forms disclosed, but on the contrary, the intention is to cover all modifications, equivalents, and alternatives falling within the spirit and scope of the invention as defined by the specification and claims.

What is claimed is:

1. A folding machine for producing a folded signature product, comprising:

a first rotating cylinder, said first rotating cylinder including a selectable blade device disposed on the periphery thereof, said selectable blade device having a tucker blade for folding products being fed into the folding machine and a knife blade for folding and cutting said products;

a second rotating cylinder adjacent to said first rotating cylinder, said second rotating cylinder including a movable jaw on the periphery thereof that cooperates with the selectable blade device on the first rotating cylinder to fold or fold and cut said products.

2. The folding machine according to claim 1, further comprising a lever for switching the selectable blade device from a position where the tucker blade is engaged and cooperates with the movable jaw to fold the products to a position where the knife blade is engaged and cooperates with the movable jaw to fold and cut the products.

3. The folding machine according to claim 2, further comprising a cap screw which is mounted to the second rotating cylinder which slides along a groove formed in the lever and locks the selectable blade device in one position or the other.

4. The folding machine according to claim 1, wherein the second rotating cylinder further includes a tucker blade disposed on the periphery thereof.

5. The folding machine according to claim 4, further comprising a third rotating cylinder including a movable jaw on the periphery thereof, wherein the movable jaw of the third rotating cylinder cooperates with the tucker blade on the second rotating cylinder to further fold the products being processed by the folding machine.

6. The folding machine according to claim 4, further comprising a rotary brush for keeping the tail section of the products from flapping about and thus becoming misaligned.

7. The folding machine according to claim 4, further comprising a half-folder stripper shoe/guide shoe which in the stripper shoe position strips the product off the surface of the second rotating cylinder and in the guide shoe position keeps the product on the surface of the second rotating cylinder.

8. The folding machine according to claim 5, further comprising a delivery guide shoe which guides the signatures between the second and third rotating cylinders.

* * * * *